US005981429A

United States Patent [19]

Kawamura et al.

[11] Patent Number: 5,981,429

[45] Date of Patent: Nov. 9, 1999

[54] REVERSIBLE THERMOSENSITIVE RECORDING MEDIUM

[75] Inventors: Fumio Kawamura; Kyoji Tsutsui; Tadafumi Tatewaki; Hiromi Furuya, all of Shizuoka-ken, Japan

[73] Assignee: Ricoh Company, Ltd., Tokyo, Japan

[21] Appl. No.: 08/906,456

[22] Filed: Aug. 5, 1997

[30] Foreign Application Priority Data

Aug. 7, 1996 [JP] Japan ..... 8-208350
Aug. 1, 1997 [JP] Japan ..... 9-207942

[51] Int. Cl.[6] ..... B41M 5/36

[52] U.S. Cl. ..... 503/207; 503/200; 503/201; 503/226

[58] Field of Search ..... 503/200, 201, 503/207, 226; 427/150–152

[56] References Cited

U.S. PATENT DOCUMENTS

| | | | |
|---|---|---|---|
| 4,628,337 | 12/1986 | Sekine et al. | 346/217 |
| 5,185,194 | 2/1993 | Miyake et al. | 428/64 |
| 5,229,189 | 7/1993 | Hiyoshi et al. | 428/195 |
| 5,250,346 | 10/1993 | Nagai et al. | 428/195 |
| 5,306,687 | 4/1994 | Furuya et al. | 503/207 |
| 5,380,693 | 1/1995 | Goto | 503/200 |
| 5,403,810 | 4/1995 | Sawamura et al. | 503/201 |
| 5,447,900 | 9/1995 | Suzaki et al. | 503/207 |
| 5,482,912 | 1/1996 | Furuya et al. | 503/207 |
| 5,498,772 | 3/1996 | Maruyama et al. | 503/216 |
| 5,521,138 | 5/1996 | Shimada et al. | 503/209 |
| 5,532,201 | 7/1996 | Goto | 503/213 |
| 5,547,500 | 8/1996 | Tsutsui | 106/21 A |

FOREIGN PATENT DOCUMENTS

| | | | |
|---|---|---|---|
| 0574879 | 12/1993 | European Pat. Off. | 503/201 |

OTHER PUBLICATIONS

Patent Abstracts of Japan [96:10, Oct. 31, 1996], abstract of JP 08–156418A.

Patent Abstracts of Japan [96:11, Nov. 29, 1996], abstract of JP 08–175012A.

*Primary Examiner*—Bruce H. Hess
*Attorney, Agent, or Firm*—Cooper & Dunham LLP

[57] ABSTRACT

A reversible thermosensitive recording medium has a support, and a reversible thermosensitive recording layer, an intermediate layer and a protective layer which are successively overlaid on the support in this order, the recording layer containing a reversible thermosensitive coloring composition which includes an electron-donating coloring compound and an electron-accepting compound and is capable of assuming a colored state and/or a decolorized state by controlling the thermal energy applied to the coloring composition or the cooling rate of the coloring composition after the application of thermal energy thereto, and the intermediate layer and/or protective layer containing an inorganic pigment material with an average particle diameter of 100 nm or less.

8 Claims, 1 Drawing Sheet

REVERSIBLE THERMOSENSITIVE RECORDING MEDIUM

BACKGROUND OF THE INVENTION

1. Field of the Invention

The present invention relates to a reversible thermosensitive recording medium comprising an electron-donating coloring compound (hereinafter referred to as a coloring agent) and an electron-accepting compound (hereinafter referred to as a color developer), capable of inducing color formation by utilizing the coloring reaction between the electron-donating compound and the electron-accepting compound. More specifically, the present invention relates to a reversible thermosensitive recording medium capable of forming a colored image therein and erasing the same therefrom by controlling the thermal energy applied thereto.

2. Discussion of Background

There is conventionally known a thermosensitive recording medium utilizing the coloring reaction between the electron-donating compound (or the coloring agent) and the electron-accepting compound (or the color developer). This kind of thermosensitive recording medium is widely used, for example, for a facsimile apparatus, a word processor, and a printer of a scientific measuring instrument. However, the coloring reaction of the conventional thermosensitive recording medium of this type has no reversibility, so that color development and decolorization cannot be alternately repeated.

Among published patents, there are several proposals for a thermosensitive recording medium which can reversibly carry out the color development and decolorization utilizing a coloring reaction between a coloring agent and a color developer. For example, a thermosensitive recording medium using phloroglucinol and gallic acid as color developers in combination is disclosed in Japanese Laid-Open Patent Application 60-193691. There is disclosed in Japanese Laid-Open Patent Application 61-237684 a reversible thermosensitive recording medium which employs a compound such as phenolphthalein or thymolphthalein as the color developer. In Japanese Laid-Open Patent Applications 62-138556, 62-138568 and 62-140881, there are disclosed reversible thermosensitive recording media, each comprising a recording layer which contains a homogeneously dissolved composition of a coloring agent, a color developer and a carboxylic acid ester. Further, in Japanese Laid-Open Patent Application 63-173684, a reversible thermosensitive recording medium comprising as a color developer an ascorbic acid derivative is disclosed. In addition, a reversible thermosensitive recording medium comprising as a color developer a salt of bis(hydroxyphenyl)acetic acid or gallic acid, and a higher aliphatic amine is disclosed in Japanese Laid-Open Patent Applications 2-188293 and 2-188294.

In the above-mentioned conventional reversible thermosensitive recording media, however, both of the stability of a colored image and the facility for decolorization are not always satisfied at the same time, and there is the problem with respect to the density of a colored image, and the stability of the repeated coloring and decolorization operations. Therefore, the conventional reversible recording media are not satisfactory for practical use.

The inventors of the present invention have previously proposed a reversible thermosensitive coloring composition which comprises an organic phosphoric acid compound, an aliphatic carboxylic acid compound or a phenol compound, each having a long-chain aliphatic hydrocarbon group therein, as a color developer, and a leuco dye as a coloring agent, as disclosed in Japanese Laid-Open Patent Application 5-124360. By use of such a reversible thermosensitive coloring composition, the color development and the decolorization can be easily carried out by controlling the heating and cooling conditions for the coloring composition, and further, the color-developed state and the decolorized state can be stably maintained at room temperature, and the color development and the decolorization can be alternately repeated in a stable condition. In this application, there is also proposed a reversible thermosensitive recording medium which comprises a recording layer containing the above-mentioned reversible thermosensitive coloring composition.

Although this kind of reversible thermosensitive recording medium attains a satisfactory level for practical use with respect to the compatibility of the stability of a colored image with the facility for decolorization, and the density of a colored image, there is yet room for improvement of the adaptability to a wide range of operating conditions and the scope of application in terms of the color development and decolorization conditions. To be more specific, when the image portion and the background portion are exposed to the sunlight or fluorescent light for a long period of time, those portions are easily subjected to color change. In particular, the recorded image portion cannot be completely erased from the recording layer, with leaving a residual image even after the decolorization operation is carried out.

Further, there is the problem of moisture resistance stability that the image density of the recorded image portion is decreased during the storage under the circumstance of high humidity.

In Japanese Laid-Open Patent Application 6-210954, it is proposed to use a phenol compound having a long-chain aliphatic hydrocarbon group as the color developer. However, the above-mentioned problems of the light and moisture resistance stabilities cannot be solved by the reversible thermosensitive recording medium comprising the above-mentioned phenol compound as the color developer.

Furthermore, in order to improve the preservation stability of the colored image in terms of light resistance, it is proposed to overlay on the reversible thermosensitive recording layer a protective layer having a reflectance of less than 50% with respect to the ultraviolet light with a wavelength of 350 nm, as disclosed in Japanese Laid-Open Patent Application 7-205547. There is disclosed in the Examples of this application the method of forming a protective layer using a formulation which comprises microcapsules containing an organic ultraviolet absorbing agent. By providing the protective layer on the recording layer in the above-mentioned manner, however, the problem of the light resistance stability cannot be completely solved.

SUMMARY OF THE INVENTION

Accordingly, an object of the present invention is to provide a reversible thermosensitive recording medium capable of stably maintaining the color development performance and the decolorization performance, coping with a wide range of operating conditions and ambient conditions, and in particular, capable of producing a colored image with improved preservation stability in terms of light resistance and moisture resistance.

The above-mentioned object of the present invention can be achieved by a reversible thermosensitive recording medium comprising a support, a reversible thermosensitive recording layer formed on the support, comprising a reversible thermosensitive coloring composition which comprises an electron-donating coloring compound and an electron-accepting compound and is capable of assuming a colored state and/or a decolorized state by controlling the thermal energy applied to the coloring composition or the cooling rate of the coloring composition after the application of thermal energy thereto, an intermediate layer formed on the reversible thermosensitive recording layer, and a protective layer formed on the intermediate layer, at least one of the intermediate layer or the protective layer comprising an inorganic pigment material with an average particle diameter of 100 nm or less.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
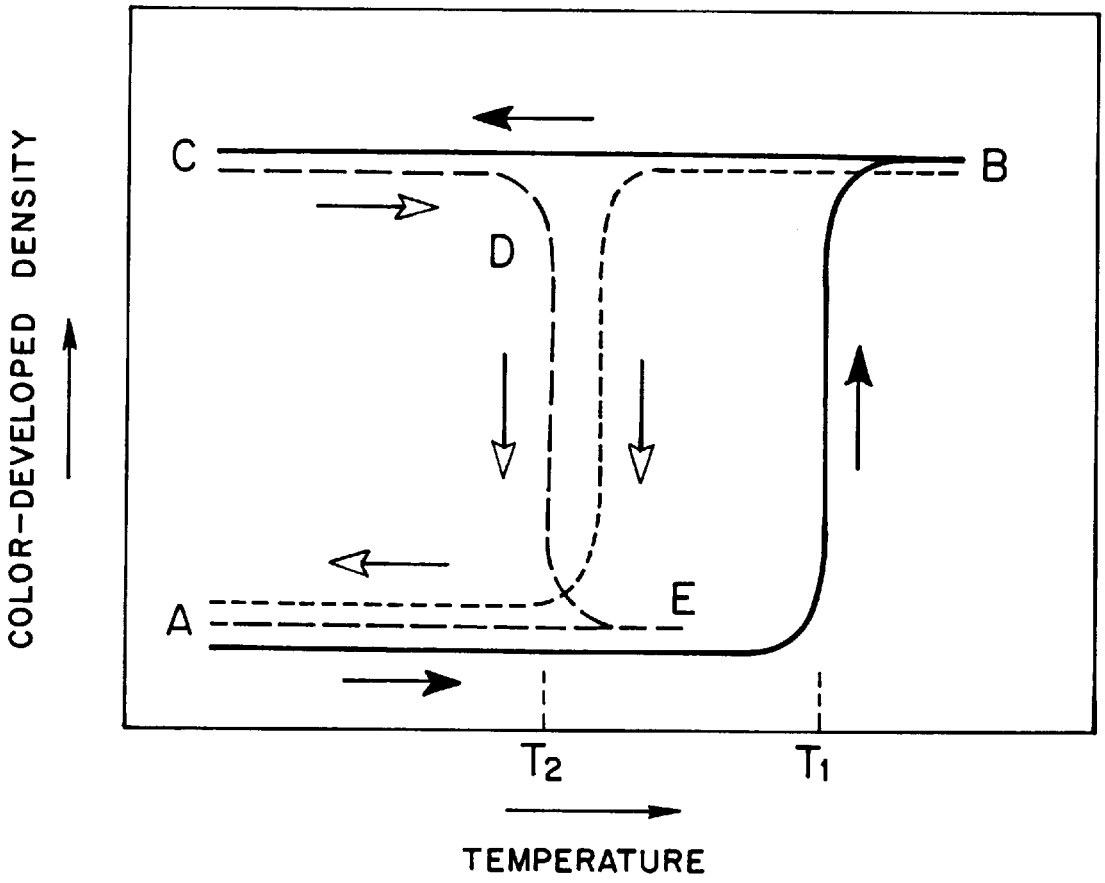
FIG. 1 is a diagram showing the color development and decolorization performance of a reversible thermosensitive coloring composition for use in a reversible thermosensitive recording medium of the present invention depending upon the temperature thereof.

The reversible thermosensitive recording medium of the present invention comprises a reversible thermosensitive recording layer, an intermediate layer and a protective layer which are successively provided on a support. When thermal printing is carried out on a recording layer of the conventional reversible thermosensitive recording medium using a thermal head, the surface of the recording layer tends to be deformed by the application of heat and pressure thereto, with a result that scars will be left on the recording layer. To prevent this from happening, the protective layer is provided on the surface of the recording medium. Further, the intermediate layer is interposed between the recording layer and the protective layer in the reversible thermosensitive recording medium of the present invention. By the provision of the intermediate layer, the adhesion between the protective layer and the recording layer can be improved, the quality change of the recording layer which may be caused by the provision of the protective layer on the recording layer can be avoided, and the additive components contained in the protective layer can be prevented from shifting to the recording layer.

At least one of the above-mentioned intermediate layer or protective layer comprises an inorganic pigment material in the form of particles with an average particle diameter of 100 nm or less for improving the light resistance stability and/or the moisture resistance stability of the reversible thermosensitive recording medium.

Any inorganic pigments that have an average particle diameter of 100 nm or less are usable as the inorganic pigment materials in the present invention.

Specific examples of the inorganic pigment for use in the present invention include metallic oxides such as zinc oxide, indium oxide, alumina, silica, zirconium oxide, tin oxide, cerium oxide, iron oxide, antimony oxide, barium oxide, calcium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate, and potassium titanate; composite materials of those oxides; metallic sulfides and sulfuric-acid-containing compounds such as zinc sulfide and barium sulfate; metallic carbides such as titanium carbide, silicon carbide, molybdenum carbide, tungsten carbide and tantalum carbide; and metallic nitrides such as aluminum nitride, silicon nitride, boron nitride, zirconium nitride, vanadium nitride, titanium nitride, niobium nitride, and gallium nitride.

In particular, it is preferable to employ an inorganic pigment which exhibits an absorption peak in the wavelength range of 400 nm or less.

Such an inorganic pigment is classified into two groups, that is, an inorganic pigment which exhibits an absorption peak in the wavelength range of the ultraviolet radiation A (UV-A), namely in the range of 320 to 400 nm, which is referred to as an inorganic pigment A, and an inorganic pigment which exhibits an absorption peak in the wavelength range shorter than the UV-A, which is referred to as an inorganic pigment B.

In the present invention, one of the above-mentioned inorganic pigment A or B may be employed alone, but the effects of the present invention can be enhanced by employing the inorganic pigments A and B in combination.

When the inorganic pigment A or B is used alone, it may be contained in one of the intermediate layer or the protective layer. When both of the inorganic pigments A and B are employed, both pigments may be contained in one of the intermediate layer or the protective layer. Alternatively, one of the inorganic pigment A or B may be contained in one of the intermediate layer or protective layer, and the other inorganic pigment may be contained in the other layer. In this case, the effects of the present invention are most significant when the inorganic pigment A is contained in the intermediate layer and the inorganic pigment B is contained in the protective layer.

Of the above-mentioned inorganic pigments, zinc oxide, titanium oxide, indium oxide, cerium oxide, tin oxide, molybdenum oxide, zinc sulfide and gallium nitride can be used as the inorganic pigment A. As the inorganic pigment B, there can be employed silica, alumina, silica-alumina, antimony oxide, magnesium oxide, zirconium oxide, barium oxide, calcium oxide, strontium oxide, silicon nitride, aluminum nitride, boron nitride and barium sulfate.

The above-mentioned inorganic pigments can be adjusted to have an average particle diameter of 100 nm or less by any of the conventional methods such as vapor phase reaction method and liquid phase reaction method.

In the reversible thermosensitive recording medium of the present invention, it is preferable that at least one of the intermediate layer or the protective layer further comprise an organic ultraviolet absorbing agent. By the addition of such an organic ultraviolet absorbing agent, the effect of the present invention can be further enhanced.

Specific examples of the organic ultraviolet absorbing agent for use in the present invention include benzotriazole ultraviolet light absorbers such as 2-(2'-hydroxy-5'-methylphenyl)benzotriazole, 2-(2'-hydroxy-5'-t-butylphenyl)benzotriazole, 2-(2'-hydroxy-3',5'-di-t-butylphenyl)benzotriazole, 2-(2'-hydroxy-3'-t-butyl-5'-methylphenyl)benzotriazole, 2-(2'-hydroxy-5'-octoxyphenyl)benzotriazole, 2-(2'-hydroxy-3',5'-di-t-butylphenyl)-5-chlorobenzotriazole, 2-(2'-hydroxy-3'-t-butyl- 5'-methylphenyl)-5-chlorobenzotriazole, and 2-(2'-hydroxy-5'-ethoxyphenyl)benzotriazole; benzophenone ultraviolet light absorbers such as 2,4-dihydroxybenzophenone, 2-hydroxy-4-methoxybenzophenone, 2-hydroxy-4-n-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, 2,2',4,4'-tetrahydroxybenzophenone, 2-hydroxy-4-methoxy-2'-carboxybenzophenone, 2-hydroxy-4-oxybenzylbenzophenone, 2-hydroxy-4-chlorobenzophenone, 2-hydroxy-4-methoxybenzophenone-5-sulfonic acid, sodium 2-hydroxy-4-methoxybenzophenone-5-sulfonate, and sodium 2,2'-dihydroxy-4,4'-dimethoxybenzophenone-sulfonate; salicylic ester ultraviolet light absorbers such as phenyl salicylate, p-octylphenyl salicylate, p-t-butylphenyl salicylate, carboxyphenyl salicylate, methylphenyl salicylate, dodecylphenyl salicylate, 2-ethylhexylphenyl salicylate, and homomenthylphenyl salicylate; cyano acrylate ultraviolet light absorbers such as 2-ethylhexyl-2-cyano-3,3'-diphenyl acrylate, and ethyl-2-cyano-3,3'-diphenyl acrylate; p-aminobenzoic acid ultraviolet light absorbers such as p-aminobenzoic acid, glyceryl p-aminobenzoate, amyl p-dimethylaminobenzoate, and ethyl p-dihydroxypropylbenzoate; cinnamic acid ultraviolet light absorbers such as p-methoxycinnamic acid-2-ethylhexyl, and p-methoxycinnamic acid-2-ethoxyethyl; 4-t-butyl-4'-methoxy-dibenzoylmethane; urocanic acid; and ethyl urocanate.

Regarding a binder agent used for the formation of the intermediate layer or the protective layer, any conventional materials having film-forming properties can be used as they are.

Examples of such a binder agent for the intermediate layer and protective layer are polyvinyl chloride, polyvinyl acetate, vinyl chloride—vinyl acetate copolymer, polyvinyl acetal, polyvinyl butyral, polycarbonate, polyacrylate, polysulfone, polyether sulfone, polyphenylene oxide, polyimide, fluoroplastic, polyamide, polyamide imide, polybenzimidazole, polystyrene, styrene copolymers, phenoxy resin, polyester, aromatic polyester, polyurethane, polyacrylic acid ester, polymethacrylic acid ester, (meth) acrylic acid ester copolymers, maleic acid copolymers, epoxy resin, alkyd resin, silicone resin, phenolic resin, polyvinyl alcohol, modified polyvinyl alcohol, polyvinyl pyrrolidone, polyethylene oxide, polypropylene oxide, methyl cellulose, ethyl cellulose, carboxymethyl cellulose, hydroxyethyl cellulose, starch, gelatine, and casein.

The intermediate layer or protective layer may further comprise a variety of curing agents and crosslinking agents in order to increase the strength of each layer.

Examples of the curing agents and crosslinking agents for use in the intermediate layer or protective layer include an isocyanate-group-containing compound, polyamide-epichlorohydrin resin, an epoxy-group-containing compound, glyoxal, and zirconium compound.

Further, for the formation of the intermediate layer or protective layer, a binder agent of an an electron radiation curing type or ultraviolet curing type may be employed. As such a binder agent, there can be employed a compound having an ethylenic unsaturated bond.

Specific examples of the above-mentioned electron radiation curing binder agent and ultraviolet curing binder agent are as follows:

1. Poly(meth)acrylate of aliphatic, alicyclic, or aromatic polyhydric alcohol and polyalkylene glycol.
2. Poly(meth)acrylate of polyhydric alcohol prepared by adding polyalkylene oxide to aliphatic, alicyclic or aromatic polyhydric alcohol.
3. Polyester poly(meth)acrylate.
4. Polyurethane poly(meth)acrylate.
5. Epoxy poly(meth)acrylate.
6. Polyamide poly(meth)acrylate.
7. Poly(meth)acryloyloxy alkyl phosphate.
8. Vinyl compound or diene compound having (meth) acryloyl group on the side chain or at the end thereof.
9. Monofunctional (meth)acrylate, vinyl pyrrolidone or (meth)acryloyl compound.
10. Cyano compound having ethylenic unsaturated bond.
11. Monocarboxylic acid or polycarboxylic acid having ethylenic unsaturated bond, and alkali metal salts, ammonium salts and amine salts thereof.
12. Ethylenic unsaturated (meth)acrylamide or alkyl-substituted (meth)acrylamide, and polymers thereof.
13. Vinyl lactam and polyvinyl lactam compound.
14. Monoether or polyether having ethylenic unsaturated bond, and esters thereof.
15. Ester of alcohol having ethylenic unsaturated bond.
16. Polyalcohol having ethylenic unsaturated bond, and esters thereof.
17. Aromatic compound having one or more ethylenic unsaturated bond, such as styrene or divinylbenzene.
18. Polyorganosiloxane compound having (meth) acryloyloxy group on the side chain or at the end portion thereof.
19. Silicone compound having ethylenic unsaturated bond.
20. Polymers or oligoester (meth)acrylate modified materials of the above-mentioned compounds 1 to 19.

When the intermediate layer or protective layer is formed using the ultraviolet curing binder agent, a photopolymerization initiator may be used in combination.

Specific examples of the photopolymerization initiator include acetophenones such as dichloroacetophenone and trichloroacetophenone, 1-hydroxycyclohexylphenylketone, benzophenone, Michler's ketone, benzoin, benzoin alkyl ether, benzyldimethyl ketal, tetramethylthiuram monosulfide, thioxanthones, azo compounds, diaryl iodonium salts, triaryl sulfonium salts, and bis(trichloromethyl) triazine compounds.

To provide the intermediate layer or the protective layer, a coating liquid may be prepared by uniformly mixing and dispersing the previously mentioned inorganic pigment and binder resin, optionally in combination with the photopolymerization initiator and the organic ultraviolet absorbing agent, and a solvent when necessary.

Specific examples of the solvent used for the preparation of the coating liquid for the intermediate layer or protective layer are as follows: water; alcohols such as methanol, ethanol, isopropanol, n-butanol and methylisocarbinol; ketones such as acetone, 2-butanone, ethyl amyl ketone, diacetone alcohol, isophorone and cyclohexanone; amides such as N,N-dimethylformamide and N,N-dimethylacetoamide; ethers such as diethyl ether, isopropyl ether, tetrahydrofuran, 1,4-dioxane and 3,4-dihydro-2H-pyran; glycol ethers such as 2-methoxyethanol, 2-ethoxyethanol, 2-butoxyethanol and ethylene glycol dimethyl ether; glycol ether acetates such as 2-methoxyethyl acetate, 2-ethoxyethyl acetate and 2-butoxyethyl acetate; esters such as methyl acetate, ethyl acetate, isobutyl acetate, amyl acetate, ethyl lactate and ethylene carbonate; aromatic hydrocarbons such as benzene, toluene and xylene; aliphatic hydrocarbons such as hexane, heptane, iso-octane and cyclohexane; halogenated hydrocarbons such as methylene chloride, 1,2-dichloroethane, dichloropropane and chlorobenzene; sulfoxides such as dimethyl sulfoxide; and pyrrolidones such as N-methyl-2-pyrrolidone and N-octyl-2-pyrrolidone.

For the preparation of the coating liquid, there can be employed various conventional dispersion mixers such as a paint shaker, ball mill, attritor, three-roll mill, keddy mill, sand mill, and colloid mill.

The coating method for providing the intermediate layer or protective layer is not particularly limited, and conventional coating methods such as blade coating, wire-bar coating, spray coating, air-knife coating, beads coating, curtain coating, gravure coating, kiss-roll coating, reverse-roll coating, and dip coating are usable.

It is preferable that the thickness of the intermediate layer or protective layer be in the range of 0.1 to 20 $\mu$m, and more preferably in the range of 0.3 to 10 $\mu$m.

It is preferable that the amount of inorganic pigment material be in the range of 1 to 95%, more preferably 5 to 75%, in terms of the volume fraction with respect to the volume of the intermediate layer or protective layer. Further, in the intermediate layer or protective layer, it is preferable that the amount of organic ultraviolet absorbing agent be in the range of 0.5 to 10 parts by weight to 100 parts by weight of the binder agent.

The protective layer may be of a laminated type, that is, comprise two or more layers. In this case, the inorganic pigment and/or organic ultraviolet absorbing agent may be contained in one of the protective layers or all the protective layers.

The reversible thermosensitive recording layer will now be explained in detail.

The reversible thermosensitive recording layer comprises a reversible thermosensitive coloring composition which comprises an electron-donating coloring compound and an electron-accepting compound and is capable of assuming a colored state and/or a decolorized state by controlling the thermal energy applied to the coloring composition or the cooling rate of the coloring composition after the application of thermal energy thereto.

The color developer for use in the reversible thermosensitive recording layer, which is used in combination with the coloring agent, has not only a molecular structure having a capability of inducing color formation in the coloring agent, but also a long-chain moiety in the molecule which controls the cohesion between the molecules thereof.

Representative examples of preferable color developers for use in the present invention include (a) an organic phosphoric acid compound, (b) an aliphatic carboxylic acid compound, and (c) a phenol compound, each having an aliphatic group with 12 or more carbon atoms. Examples of such an aliphatic group includes a straight-chain or branched alkyl group and alkenyl group, and each may have a substituent such as a halogen atom, an alkoxyl group, or an ester group.

(a) Organic phosphoric acid compound

To be more specific, the above-mentioned organic phosphoric acid compound (a) is represented by the following formula (1):

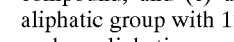

$$R^1—PO(OH)_2 \quad (1)$$

wherein $R^1$ is an aliphatic group having 12 or more carbon atoms.

Specific examples of the organic phosphoric acid compound represented by formula (1) are as follows: dodecylphosphonic acid, tetradecylphosphonic acid, hexadecylphosphonic acid, octadecylphosphonic acid, eicosylphosphonic acid, dococylphosphonic acid, tetracosylphosphonic acid, hexacosylphosphonic acid, and octacosylphosphonic acid.

(b) Aliphatic carboxylic acid compound

As the aforementioned aliphatic carboxylic acid compounds, α-hydroxycarboxylic acids represented by the following formula (2) are preferably employed:

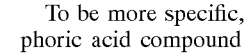

$$R^2—CH(OH)—COOH \quad (2)$$

wherein $R^2$ is an aliphatic group having 12 or more carbon atoms.

Specific examples of the α-hydroxycarboxylic acids of formula (2) are as follows: α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanic acid, α-hydroxydocosanoic acid, α-hydroxytetracosanoic acid, α-hydroxyhexacosanoic acid, and α-hydroxyoctacosanoic acid.

In particular, there is preferably employed an aliphatic carboxylic acid compound having an aliphatic group with 12 or more carbon atoms, which has a halogen atom as a substituent at least at the α- or β-position.

Specific examples of such a halogen-substituted compound are as follows: 2-bromohexadecanoic acid, 2-bromoheptadecanoic acid, 2-bromooctadecanoic acid, 2-bromoeicosanic acid, 2-bromodocosanoic acid, 2-bromotetracosanoic acid, 3-bromooctadecanoic acid, 3-bromoeicosanic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanic acid, 2-fluorodocosanoic acid, 2-iodohexadecanoic acid, 2-iodooctadecanoic acid, 3-iodohexadecanoic acid, 3-iodooctadecanoic acid, and perfluorooctadecanoic acid.

Furthermore, there is also preferably employed an aliphatic carboxylic acid compound having oxo group in the carbon chain of the aliphatic group at least at the α-, β- or γ-position.

Specific examples of such an oxo-group-containing aliphatic carboxylic acid compound are as follows: 2-oxododecanoic acid, 2-oxotetradecanoic acid, 2-oxohexadecanoic acid, 2-oxooctadecanoic acid, 2-oxoeicosanic acid, 2-oxotetracosanoic acid, 3-oxododecanoic acid, 3-oxotetradecanoic acid, 3-oxohexadecanoic acid, 3-oxooctadecanoic acid, 3-oxoeicosanic acid, 3-oxotetracosanoic acid, 4-oxohexadecanoic acid, 4-oxoheptadecanoic acid, 4-oxooctadecanoic acid, and 4-oxodocosanoic acid.

Further, the following dibasic acid compound represented by formula (3) can also be employed as the aliphatic carboxylic acid compound:

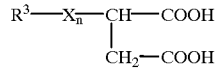

$$R^3—X_n—CH(CH_2—COOH)—COOH \quad (3)$$

wherein $R^3$ is an aliphatic group having 12 or more carbon atoms; X is an oxygen atom or sulfur atom; and n is an integer of 1 or 2.

Specific examples of the dibasic acid compound of formula (3) are as follows: dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyldithiomalic acid, and tetracosyldithiomalic acid.

There can be employed as the aliphatic carboxylic acid compound a dibasic acid compound represented by the following formula (4):

(4)

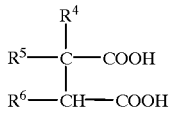

wherein $R^4$, $R^5$ and $R^6$ are each a hydrogen atom or an aliphatic group, provided that at least one of $R^4$, $R^5$ or $R^6$ is an aliphatic group having 12 or more carbon atoms.

Specific examples of the dibasic acid compound of formula (4) are as follows: dodecylbutanedioic acid, tridecylbutanedioic acid, tetradecylbutanedioic acid, pentadecylbutanedioic acid, octadecylbutanedioic acid, eicosylbutanedioic acid, docosylbutenedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-dodecylbutanedioic acid, 2-octyl-3-hexadecylbutanedioic acid, and 2-tetradecyl-3-octadecylbutanedioic acid.

There can also be employed as the aliphatic carboxylic acid compound a dibasic acid compound represented by the following formula (5):

(5)

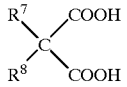

wherein $R^7$ and $R^8$ are each a hydrogen atom or an aliphatic group, provided that at least one of $R^7$ or $R^8$ is an aliphatic group having 12 or more carbon atoms.

Specific examples of the dibasic acid compound of formula (5) are as follows: dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetradocosylmalonic acid, ethyloctadecylmalonic acid, ethyleicosylmalonic acid, ethyldocosylmalonic acid, and ethyltetracosylmalonic acid.

There can also be employed as the aliphatic carboxylic acid compound a dibasic acid compound represented by the following formula (6):

(6)

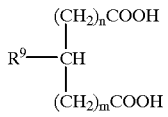

wherein $R^9$ is an aliphatic group having 12 or more carbon atoms; and n is an integer of 0 or 1, and m is an integer of 1 to 3, provided that when n is 0(zero), m is 2 or 3, and that when n is 1, m is 1 or 2.

Specific examples of the dibasic acid compound of formula (6) are as follows: 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, and 2-docosyl-hexanedioic acid.

In addition, as the aliphatic carboxylic acid compound, there can also be employed a tribasic acid compound such as citric acid acylated by a long chain aliphatic acid.

Specific examples of the above-mentioned tribasic acid are as follows:

(7)

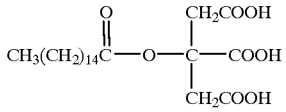

(8)

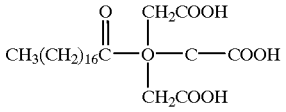

(9)

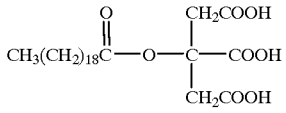

(C) Phenol compound

As the phenol compound serving as the color developer, the following compound of formula (10) can be employed:

(10)

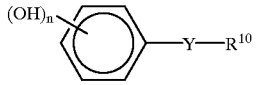

wherein Y is —S—, —O—, —CONH—, —NHCONH—, —$NHSO_2$—, —CH=CH—CONH— or —COO—; $R^{10}$ is an aliphatic group having 12 or more carbon atoms; and n is an integer of 1 to 3.

Specific examples of the phenol compound represented by formula (10) are as follows: p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, tetracosyl gallate, N-dodecyl-p-hydroxycinnamamide, N-tetradecyl-p-hydroxycinnamamide, N-octadecyl-p-hydroxycinnamamide, N-docosyl-p-hydroxycinnamamide, N-octacosyl-p-hydroxycinnamamide, 4-hydroxydocosanoylaniline, 4-hydroxyheptadecanoylaniline, 4-hydroxynonadecanoylaniline, 3-hydroxynonadecanoylaniline, 3-hydroxydocosanoylaniline, 4-N-octadecylsulfonylaminophenol, 4-N-dodecylsulfonylaminophenol, N-4-hydroxyphenyl-N'-dodecylurea, N-4-hydroxyphenyl-N'-octadecylurea, and N-4-hydroxyphenyl-N'-docosylurea.

The reversible thermosensitive recording layer comprises the above-mentioned color developer, and a coloring agent and a binder resin. The coloring agent for use in the present invention is a colorless or light-colored dye precursor such as a leuco dye, having electron-donating properties. Such a coloring agent is not particularly limited, and conventionally known leuco compounds such as triphenylmethane phthalide compounds, fluoran compounds, phenothiazine compounds, leuco auramine compounds and indolinophthalide compounds are preferably employed.

In particular, the following compounds of formulas (11) and (12) are preferable as the coloring agents:

(11)

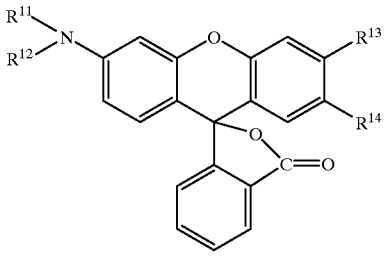

(12)

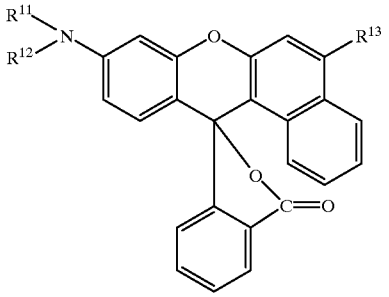

wherein $R^{11}$ is a hydrogen atom or an alkyl group having 1 to 4 carbon atoms; $R^{12}$ is an alkyl group having 1 to 6 carbon atoms, a cycloalkyl group, or a phenyl group which may have a substituent; $R^{13}$ is a hydrogen atom, an alkyl group having 1 or 2 carbon atoms, an alkoxyl group, or a halogen atom; and $R^{14}$ is a hydrogen atom, methyl group, a halogen atom or an amino group which may have a substituent.

In the formulas (11) and (12), examples of the substituent for the phenyl group represented by $R^{12}$ include an alkyl group such as methyl group or ethyl group; an alkoxyl group such as methoxy group or ethoxy group; and a halogen atom.

Examples of the substituent for the amino group represented by $R^{14}$ include an alkyl group, an aryl group and an aralkyl group. In this case, the aryl group and aralkyl group may have a substituent such as an alkyl group, a halogen atom, or an alkoxyl group.

Specific examples of the compounds of formulas (11) and (12) serving as the coloring agents are as follows:

2-anilino-3-methyl-6-diethylaminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminof luoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran, 2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran, and
1,2-benzo-6-(N-ethyl-N-toluidino)fluoran.

In addition to the above, the following coloring agents can also be employed in the present invention:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(o-methoxycarbonylamino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trichloromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran, benzo leuco methylene blue,
2-[3,6-bis(diethylamino)]-6-(o-chloroanilino) xanthylbenzoic acid lactam,
2-[3,6-bis(diethylamino)]-9-(o-chloroanilino) xanthylbenzoic acid lactam,
3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3,6-bis(dimethylamino)fluorenespiro (9,3')-6'-dimethylaminophthalide,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3,3-bis(2-ethoxy-4-diethylaminophenyl)-4-azaphthalide,
3,3-bis(2-ethoxy-4-diethylaminophenyl)-7-azaphthalide,
6'-chloro-8'-methoxy-benzoindolino-spiropyran, and
6'-bromo-2'-methoxy-benzoindolino-spiropyran.

The mixing ratio of the coloring agent to the color developer in the reversible thermosensitive recording layer varies depending on the combination of compounds to be employed. It is preferable that the molar ratio of the color developer to the coloring agent be in the range of 1 to 20, more preferably 2 to 10. When the ratio of the coloring developer to the coloring agent is within the above-mentioned range, the image density of a colored state is sufficient.

Furthermore, in the reversible thermosensitive recording layer, it is preferable that the amount ratio by weight of a mixture of the coloring agent and the color developer to a binder resin be in the range of (0.1:1) to (10:1).

The same binder agents as mentioned in the formation of the intermediate layer or protective layer can be employed for the formation of the recording layer. Furthermore, the same electron radiation curing resin or ultraviolet curing resin as in the formation of the intermediate layer or protective layer may be also employed.

To provide the reversible thermosensitive recording layer on a support, the coating liquid for the recording layer may be prepared by uniformly mixing and dispersing the previously mentioned color developer, coloring agent and binder resin in the same solvent using the same dispersion mixer as mentioned in the preparation of the intermediate layer or protective layer coating liquid, and the thus prepared coating liquid may be coated on the support by the same coating method as mentioned above.

It is preferable that the thickness of the reversible thermosensitive recording layer be in the range of 1 to 20 μm, more preferably in the range of 3 to 10 μm.

Any material can be used for the support of the reversible thermosensitive recording medium so long as it can support the recording layer thereon. For example, a sheet of paper, a synthetic paper, a film made of a resin such as polyester, a metallic film, and a composite member of the above-mentioned materials can be employed.

The reversible thermosensitive recording layer for use in the present invention can reversibly assume a color-developed state and a decolorized state by controlling the temperature of the coloring composition contained in the recording layer in the heating step and/or controlling the cooling rate in the cooling step after the heating step. The color development and decolorization phenomenon of the reversible thermosensitive coloring composition for use in the present invention will now be explained with reference to FIG. 1.

In FIG. 1, the abscissa axis of the graph indicates the temperature of a reversible thermosensitive coloring composition, and the ordinate axis indicates the color-developed density of the reversible thermosensitive coloring composition. As is apparent from the graph, the color-developed density of the reversible thermosensitive coloring composition for use in the present invention changes depending on the temperature thereof.

In FIG. 1, reference symbol A shows the decolorized state of the reversible thermosensitive coloring composition at room temperature. When the temperature of the coloring composition in the decolorized state A is raised and reaches a temperature $T_1$, the color development takes place because the coloring composition begins to fuse at the temperature $T_1$. Thus, reference symbol B shows the color-developed state of the composition which is in a fused condition.

When the temperature of the fused composition in the color-developed state B is rapidly decreased to room temperature, the color-developed state is maintained as the color-developed state C, passing along the route indicated by the solid line between B and C. Reference symbol C shows the color-developed state of the composition in a solid form at room temperature. It depends on the descending rate of temperature in the cooling step whether the color-developed state of the coloring composition can be maintained at room temperature or not. If the fused coloring composition in the color-developed state B is gradually cooled, decolorization takes place while the temperature is descending, passing along the route indicated by the dotted line between B and A. As a result, the coloring composition returns to the initial decolorized state A, or the color-developed density of the composition becomes relatively lower than that of the composition in the color-developed state C.

When the composition in the color-developed state C, which is obtained from the color-developed state B by rapid cooling, is heated again, decolorization takes place at a temperature $T_2$, that is lower than the color development temperature $T_1$, and the color-developed density of the composition is decreased, passing along the route indicated by the broken line between D and E. Thereafter, by decreasing the temperature of the composition, the composition is returned to the initial decolorized state A. The color development temperature and the decolorization temperature vary depending on the color developer and coloring agent employed for the reversible thermosensitive coloring composition, so that the color developer and the coloring agent may be selected according to the application of the reversible thermosensitive coloring composition. In addition, the color-developed density of the composition in the color-developed state B is not always the same as that of the composition in the color-developed state C.

In the color-developed state C of the reversible thermosensitive coloring composition, which is obtained at room temperature by rapidly cooling the fused composition in the color-developed state B, the color developer and the coloring agent are mixed to such a degree that the molecules of the color developer and the coloring agent are in contact with each other to induce the coloring reaction. In such a color-developed state C, the color developer and the coloring agent form an aggregation structure on a molecular level to maintain the color development phenomenon. It is considered that the color-developed state can be maintained in a stable condition at room temperature owing to the formation of the above-mentioned aggregation structure.

On the other hand, the molecules of the color developer and those of the coloring agent cause the phase separation in the decolorized state. In such a decolorized state, the molecules of at least one component, the color developer or the coloring agent, are independently gathered to form a domain or caused to crystallize out. The molecules of the coloring agent can be separated from those of the color developer by the formation of a domain or crystallization, so that the decolorized state can be stabilized. According to the present invention, in many cases, the completely decolorized state can be obtained by the phase separation of the color developer from the coloring agent, and the crystallization of the color developer.

As shown in FIG. 1, the decolorization takes place when the fused composition in the color-developed state B is gradually cooled, or when the solid composition in the color-developed state C is heated to the temperature $T_2$. In both cases, the aggregation structure of the molecules of the color developer and the coloring agent is broken, and at the same time, the phase separation is induced and the color developer crystallizes out in the composition at the decolorization temperature.

In the reversible thermosensitive recording medium of the present invention, a colored recording image can be formed in the recording layer in such a manner that the recording medium is heated to fuse the coloring composition, for example, by using a thermal head, and then rapidly cooled. To erase the colored recording image, the recording medium is once heated and thereafter gradually cooled. Alternatively, the recording medium in the color-developed state is heated to a temperature ($T_2$) which is lower than the color development temperature ($T_1$). The above-mentioned two methods for erasing the colored recording image are the same in the sense that the recording medium is temporarily retained at a temperature where the molecules of the color developer and those of the coloring agent cause phase separation or at least one of the color developer or the coloring agent is caused to crystallize.

In the color development process, the recording medium is once heated to the color development temperature, and then rapidly cooled. Such a rapid cooling step is necessary to prevent the reversible thermosensitive recording medium from being retained at the temperature of phase separation or crystallization.

To achieve the rapid or gradual cooling operation in the color development and decolorization process, the temperature-descending rate may be relatively determined according to the combination of the color developer and the coloring agent for use in the reversible thermosensitive coloring composition.

To obtain a colored recording image in the reversible thermosensitive recording medium of the present invention, the recording medium may be once heated to a temperature higher than the color development temperature, and thereafter rapidly cooled. To achieve the above-mentioned heating and cooling operations, the recording layer of the recording medium may be heated imagewise for a short period of time using a thermal head or by the application of laser beam thereto. In such a case, the recording layer is just partially heated, and the heat diffusion takes place immediately after the completion of heating step. Therefore, the recording medium can be rapidly cooled. Thus, a color-developed state can be maintained in a stable condition.

To erase the colored recording image formed in the reversible thermosensitive recording medium, the recording medium may be heated for a relatively long period of time, followed by gradual cooling. When the recording medium is heated for a relatively long period of time, the temperature of the recording medium is necessarily increased in a large area. Therefore, the temperature-descending rate becomes relatively slow in the cooling step, so that the decolorization takes place in the process of gradual cooling. In this case, a heat roller, heat stamp, or heated air may be used as the heating means, or the recording medium may be heated for a long period of time by use of the thermal head.

Alternatively, the colored recording image can be erased from the recording medium by temporarily heating the recording medium to a specific temperature lower than the color development temperature. In this case, the thermal head is preferably employed as the heating means. To erase the colored recording image, the thermal energy applied to the recording medium by the thermal head may be lowered by controlling the applied voltage and pulse width as compared with the applied thermal energy in the image recording process. According to this method, the recording and erasing operations can be carried out and the overwriting operation can be achieved by use of the identical thermal head. As a matter of course, the heat roller and the heat stamp can also be employed in such a case.

Other features of this invention will become apparent in the course of the following description of exemplary embodiments, which are given for illustration of the invention and are not intended to be limiting thereof.

EXAMPLE 1

Formation of Reversible Thermosensitive Recording Layer (Formulation for recording layer coating liquid)

| | Parts by Weight |
|---|---|
| N-4-hydroxyphenyl-N'-octadecylurea | 1.6 |
| 2-anilino-3-methyl-6-(N,N-diethylamino)fluoran | 0.9 |
| Vinyl chloride-vinyl acetate copolymer (Trademark "VYHH", made by Union Carbide Japan K. K.) | 5 |
| Toluene | 25 |
| 2-butanone | 15 |

The above-mentioned 2-anilino-3-methyl-6-(N,N-diethylamino)fluoran (coloring agent) and vinyl chloride—vinyl acetate copolymer (binder agent) were completely dissolved in a mixed solvent of toluene and 2-butanone. To the thus prepared solution, N-4-hydroxyphenyl-N'-octadecylurea (color developer) was added. The thus obtained mixture was dispersed and ground for 96 hours using a paint shaker, whereby a coating liquid for a reversible thermosensitive recording layer was prepared.

The above-mentioned coating liquid was coated on a white polyester film with a thickness of 100 μm using a wire bar, and dried under the application of heat thereto. Thus, a reversible thermosensitive recording layer with a thickness of about 7 μm was provided on the polyester film serving as a support.

Formation of Intermediate Layer (Formulation for intermediate layer coating liquid)

| | Parts by Weight |
|---|---|
| Polyvinyl alcohol (Trademark "PVA-117", made by Kuraray Co., Ltd.) | 10 |

-continued

| | Parts by Weight |
|---|---|
| Finely-divided particles of iron oxide (with an average particle diameter of 80 nm) | 10 |
| Deionized water | 90 |

The above-mentioned polyvinyl alcohol (binder agent) was completely dissolved in the deionized water (solvent), so that a solution of polyvinyl alcohol was prepared. With the addition of the finely-divided particles of iron oxide with an average particle diameter of 80 nm (inorganic pigment) to the above-mentioned solution, the resultant mixture was dispersed and ground for 96 hours using a paint shaker. Thus, a coating liquid for an intermediate layer was obtained.

The thus obtained coating liquid was coated on the above prepared recording layer using a wire bar, and dried under the application of heat thereto, so that an intermediate layer with a thickness of about 2 μm was provided on the recording layer.

Formation of Protective Layer (Formulation for protective layer coating liquid)

| | Parts by Weight |
|---|---|
| Dipentaerythritol hexaacrylate (Trademark "DPHA", made by Nippon Kayaku Co., Ltd.) | 10 |
| 1-hydroxycyclohexylphenyl-ketone (Trademark "Irgacure 184", made by Ciba-Geigy, Ltd.) | 0.1 |
| 2-butanone | 45 |

The above-mentioned dipentaerythritol hexaacrylate and 1-hydroxycyclohexylphenylketone were dissolved in 2-butanone, so that a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 μm was provided on the intermediate layer.

Thus, a reversible thermosensitive recording medium No. 1 according to the present invention was fabricated.

EXAMPLE 2

The procedure for fabrication of the reversible thermosensitive recording medium No. 1 in Example 1 was repeated except that the iron oxide with an average particle diameter of 80 nm for use in the formulation for the intermediate layer coating liquid in Example 1 was replaced by zinc sulfide (inorganic pigment A) with an average particle diameter of 50 nm.

Thus, a reversible thermosensitive recording medium No. 2 according to the present invention was fabricated.

EXAMPLE 3

The procedure for fabrication of the reversible thermosensitive recording medium No. 1 in Example 1 was repeated except that the polyvinyl alcohol "PVA-117" and the iron oxide with an average particle diameter of 80 nm for use in the formulation for the intermediate layer coating liquid in Example 1 were respectively replaced by commercially available polyvinyl alcohol "PVA-205" (Trademark), made by Kuraray Co., Ltd., and cerium oxide (inorganic pigment A) with an average particle diameter of 40 nm.

Thus, a reversible thermosensitive recording medium No. 3 according to the present invention was fabricated.

EXAMPLE 4

The procedure for fabrication of the reversible thermosensitive recording medium No. 1 in Example 1 was repeated except that the formulations for the reversible thermosensitive recording layer coating liquid, the intermediate layer coating liquid and the protective layer coating liquid were respectively changed to the following formulations (1), (2) and (3):

(Formulation for recording layer coating liquid (1))

| | Parts by Weight |
|---|---|
| N-4-hydroxyphenyl-N'-octadecylurea | 1.6 |
| 3-(4-diethylamino-2-ethoxyphenyl)-3-(1-ethyl-2-methylindole-3-yl)-4-azaphthalide | 0.9 |
| Vinyl chloride-vinyl acetate copolymer (Trademark "VYHH", made by Union Carbide Japan K. K.) | 5 |
| Toluene | 25 |
| 2-butanone | 15 |

(Formulation for intermediate layer coating liquid (2))

| | Parts by Weight |
|---|---|
| Polyvinyl alcohol (Trademark "PVA-117", made by Kuraray Co., Ltd.) | 10 |
| Finely-divided particles of zinc oxide (with an average particle diameter of 20 nm) {Inorganic pigment A} | 10 |
| Deionized water | 90 |

(Formulation for protective layer coating liquid (3))

| | Parts by weight |
|---|---|
| Urethane-acrylate ultraviolet curing resin (Trademark "C7-157" made by Dainippon Ink & Chemicals, Incorporated) | 50 |
| Ethyl acetate | 50 |

Thus, a reversible thermosensitive recording medium No. 4 according to the present invention was fabricated.

EXAMPLE 5

The procedure for fabrication of the reversible thermosensitive recording medium No. 4 in Example 4 was repeated except that the formulation for the intermediate layer coating liquid was changed to the following formulation:

(Formulation for intermediate layer coating liquid)

| | Parts by Weight |
|---|---|
| Polyvinyl alcohol (Trademark "PVA-120", made by Kuraray Co., Ltd.) | 10 |
| Finely-divided particles of silicon nitride (with an average particle diameter of 70 nm) {Inorganic pigment B} | 10 |
| Deionized water | 90 |

Thus, a reversible thermosensitive recording medium No. 5 according to the present invention was fabricated.

EXAMPLE 6

The procedure for fabrication of the reversible thermosensitive recording medium No. 4 in Example 4 was repeated except that the formulation for the intermediate layer coating liquid was changed to the following formulation:

(Formulation for intermediate layer coating liquid)

| | Parts by Weight |
|---|---|
| Polyvinyl alcohol (Trademark "PVA-117", made by Kuraray Co., Ltd.) | 10 |
| Finely-divided particles of antimony oxide (with an average particle diameter of 70 nm) {Inorganic pigment B} | 10 |
| Deionized water | 90 |

Thus, a reversible thermosensitive recording medium No. 6 according to the present invention was fabricated.

EXAMPLE 7

The procedure for fabrication of the reversible thermosensitive recording medium No. 4 in Example 4 was repeated except that the formulation for the intermediate layer coating liquid was changed to the following formulation:

(Formulation for intermediate layer coating liquid)

| | Parts by Weight |
|---|---|
| Ethylene-vinyl alcohol copolymer {Binder agent} | 20 |
| Finely-divided particles of zinc oxide (with an average particle diameter of 20 nm) {Inorganic pigment A} | 10 |
| Finely-divided particles of silica (with an average particle diameter of 20 nm) {Inorganic pigment B} | 10 |
| Deionized water {Solvent} | 90 |
| n-propanol {Solvent} | 90 |

Thus, a reversible thermosensitive recording medium No. 7 according to the present invention was fabricated.

EXAMPLE 8

The procedure for fabrication of the reversible thermosensitive recording medium No. 4 in Example 4 was repeated except that the formulation for the intermediate layer coating liquid was changed to the following formulation:

(Formulation for intermediate layer coating liquid)

| | Parts by Weight |
|---|---|
| Ethylene-vinyl alcohol copolymer {Binder agent} | 20 |
| Finely-divided particles of indium oxide (with an average particle diameter of 40 nm) {Inorganic pigment A} | 10 |
| Finely-divided particles of magnesium oxide (with an average particle diameter of 50 nm) {Inorganic pigment B} | 10 |
| Deionized water {Solvent} | 90 |
| n-propanol {Solvent} | 90 |

Thus, a reversible thermosensitive recording medium No. 8 according to the present invention was fabricated.

EXAMPLE 9

The procedure for fabrication of the reversible thermosensitive recording medium No. 4 in Example 4 was repeated except that the formulation for the intermediate layer coating liquid was changed to the following formulation:

(Formulation for intermediate layer coating liquid)

| | Parts by Weight |
|---|---|
| Polyvinyl pyrrolidone {Binder agent} | 20 |
| Finely-divided particles of cerium oxide (with an average particle diameter of 40 nm) {Inorganic pigment A} | 10 |
| Finely-divided particles of zirconium oxide (with an average particle diameter of 30 nm) {Inorganic pigment B} | 10 |
| Deionized water {Solvent} | 180 |

Thus, a reversible thermosensitive recording medium No. 9 according to the present invention was fabricated.

EXAMPLE 10

The procedure for fabrication of the reversible thermosensitive recording medium No. 4 in Example 4 was repeated except that the formulation for the intermediate layer coating liquid was changed to the following formulation:

(Formulation for intermediate layer coating liquid)

| | Parts by Weight |
|---|---|
| Polyester (Trademark "Vylon 200" made by Toyobo Co., Ltd.) {Binder agent} | 20 |
| Finely-divided particles of titanium oxide (with an average particle diameter of 90 nm) {Inorganic pigment A} | 10 |
| Finely-divided particles of alumina (with an average particle diameter of 20 nm) {Inorganic pigment B} | 10 |
| Toluene | 120 |
| 2-butanone | 60 |

Thus, a reversible thermosensitive recording medium No. 10 according to the present invention was fabricated.

EXAMPLE 11

Formation of Reversible Thermosensitive Recording Layer

The reversible thermosensitive recording layer was provided on the white polyester film serving as a support in the same manner as in Example 4.

Formation of Intermediate Layer (Formulation for intermediate layer coating liquid)

| | Parts by Weight |
|---|---|
| Polyvinyl alcohol | 10 |
| Deionized water | 90 |

The polyvinyl alcohol was completely dissolved in deionized water, so that a coating liquid for an intermediate layer was obtained.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer (Formulation for protective layer coating liquid)

| | Parts by Weight |
|---|---|
| Urethane-acrylate ultraviolet curing resin (Trademark "C7-157" made by Dainippon Ink & Chemicals, Incorporated) | 50 |
| Ethyl acetate | 50 |
| Finely-divided particles of zinc oxide (with an average particle diameter of 20 nm) {Inorganic pigment A} | 2.5 |

The above-mentioned urethane—acrylate ultraviolet curing resin was completely dissolved in ethyl acetate. With the addition of the finely-divided particles of zinc oxide with an average particle diameter of 20 nm to the above prepared solution, the resultant mixture was dispersed and ground for 96 hours using a paint shaker. Thus, a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 $\mu$m was provided on the intermediate layer.

Thus, a reversible thermosensitive recording medium No. 11 according to the present invention was fabricated.

EXAMPLE 12

The procedure for fabrication of the reversible thermosensitive recording medium No. 11 in Example 11 was repeated except that the formulations for the intermediate layer coating liquid and the protective layer coating liquid were respectively changed to the following formulations (1) and (2):

(Formulation for intermediate layer coating liquid (1))

| | Parts by Weight |
|---|---|
| Water-soluble polyvinyl butyral | 10 |
| Deionized water | 90 |

(Formulation for protective layer coating liquid (2))

| | Parts by Weight |
|---|---|
| Urethane-acrylate ultraviolet curing resin (Trademark "C7-157" made by Dainippon Ink & Chemicals, Incorporated) | 50 |
| Ethyl acetate | 50 |
| Finely-divided particles of barium sulfate (with an average particle diameter of 90 nm) {Inorganic pigment B} | 2.5 |

Thus, a reversible thermosensitive recording medium No. 12 according to the present invention was fabricated.

EXAMPLE 13

The procedure for fabrication of the reversible thermosensitive recording medium No. 11 in Example 11 was repeated except that the formulations for the intermediate layer coating liquid and the protective layer coating liquid were respectively changed to the following formulations (1) and (2):

(Formulation for intermediate layer coating liquid (1))

| | Parts by Weight |
|---|---|
| Polyvinyl butyral | 10 |
| Ethanol | 90 |

(Formulation for protective layer coating liquid (2))

| | Parts by Weight |
|---|---|
| Urethane-acrylate ultraviolet curing resin (Trademark "C7-157" made by Dainippon Ink & Chemicals, Incorporated) | 50 |
| Ethyl acetate | 50 |
| Finely-divided particles of zirconium oxide (with an average particle diameter of 30 nm) {Inorganic pigment B} | 2.5 |

Thus, a reversible thermosensitive recording medium No. 13 according to the present invention was fabricated.

EXAMPLE 14

Formation of Reversible Thermosensitive Recording Layer

The reversible thermosensitive recording layer was provided on the white polyester film serving as a support in the same manner as in Example 11.

Formation of Intermediate Layer (Formulation for intermediate layer coating liquid)

| | Parts by Weight |
|---|---|
| Polyester (Trademark "Vylon 200" made by Toyobo Co., Ltd.) {Binder agent} | 10 |
| Finely-divided particles of antimony oxide (with an average particle diameter of 30 nm) {Inorganic pigment B} | 10 |
| 2-butanone {Solvent} | 30 |
| Toluene {Solvent} | 60 |

The above-mentioned polyester was completely dissolved in the mixed solvent of 2-butanone and toluene. With the addition of the finely-divided particles of antimony oxide with an average particle diameter of 30 nm to the above prepared solution, the resultant mixture was dispersed and ground for 96 hours using a paint shaker, so that a coating liquid for an intermediate layer was obtained.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer (Formulation for protective layer coating liquid)

| | Parts by Weight |
|---|---|
| Urethane-acrylate ultraviolet curing resin (Trademark "C7-157" made by Dainippon Ink & Chemicals, Incorporated) | 50 |
| Ethyl acetate | 50 |
| Finely-divided particles of cerium oxide (with an average particle diameter of 20 nm) {Inorganic pigment A} | 1 |

The urethane—acrylate ultraviolet curing resin was completely dissolved in ethyl acetate. With the addition of the finely-divided particles of cerium oxide with an average particle diameter of 20 nm to the above prepared solution, the resultant mixture was dispersed and ground for 96 hours using a paint shaker. Thus, a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 $\mu$m was provided on the intermediate layer.

Thus, a reversible thermosensitive recording medium No. 14 according to the present invention was fabricated.

EXAMPLE 15

Formation of Reversible Thermosensitive Recording Layer

The reversible thermosensitive recording layer was provided on the white polyester film serving as a support in the same manner as in Example 11.

Formation of Intermediate Layer
(Formulation for intermediate layer coating liquid)

| | Parts by Weight |
|---|---|
| Ethylene-vinyl alcohol copolymer {Binder agent} | 10 |
| Finely-divided particles of zirconium oxide (with an average particle diameter of 30 nm) {Inorganic pigment B} | 10 |
| Deionized water {Solvent} | 90 |
| n-propanol {Solvent} | 90 |

The above-mentioned ethylene—vinyl alcohol copolymer was completely dissolved in the mixed solvent of deionized water and n-propanol with stirring under the application of heat thereto. With the addition of the finely-divided particles of zirconium oxide with an average particle diameter of 30 nm to the above prepared solution, the resultant mixture was dispersed and ground for 96 hours using a paint shaker, so that a coating liquid for an intermediate layer was obtained.

The thus obtained coating liquid was coated on the above prepared recording layer using a wire bar, and dried under the application of heat thereto, so that an intermediate layer with a thickness of about 2 μm was provided on the recording layer.

Formation of Protective Layer
(Formulation for protective layer coating liquid)

| | Parts by Weight |
|---|---|
| Urethane-acrylate ultraviolet curing resin (Trademark "C7-157" made by Dainippon Ink & Chemicals, Incorporated) | 50 |
| Ethyl acetate | 50 |
| Finely-divided particles of titanium oxide (with an average particle diaineter of 90 nm) {Inorganic pigment A} | 1 |

The above-mentioned urethane—acrylate ultraviolet curing resin was completely dissolved in ethyl acetate. With the addition of the finely-divided particles of titanium oxide with an average particle diameter of 90 nm to the above prepared solution, the resultant mixture was dispersed and ground for 96 hours using a paint shaker. Thus, a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 μm was provided on the intermediate layer.

Thus, a reversible thermosensitive recording medium No. 15 according to the present invention was fabricated.

EXAMPLE 16

Formation of Reversible Thermosensitive Recording Layer

The reversible thermosensitive recording layer was provided on the white polyester film serving as a support in the same manner as in Example 15.

Formation of Intermediate Layer

The intermediate layer was provided on the above prepared reversible thermosensitive recording layer in the same manner as in Example 15 except that the formulation for the intermediate layer coating liquid employed in Example 15 was changed to the following formulation:

(Formulation for intermediate layer coating liquid)

| | Parts by Weight |
|---|---|
| Ethylene-vinyl alcohol copolymer | 10 |
| Finely-divided particles of zinc oxide (with an average particle diameter of 20 nm) {Inorganic pigment A} | 10 |
| Deionized water | 90 |
| n-propanol | 90 |

Formation of Protective Layer
(Formulation for protective layer coating liquid)

| | Parts by Weight |
|---|---|
| Dipentaerythritol hexaacrylate (Trademark "DPHA", made by Nippon Kayaku Co., Ltd.) | 10 |
| 1-hydroxycyclohexylphenyl-ketone (Trademark "Irgacure 184", made by Ciba-Geigy, Ltd.) | 0.1 |
| Finely-divided particles of antimony oxide (with an average particle diameter of 20 nm) {Inorganic pigment B} | 1 |
| 2-butanone | 45 |

The above-mentioned dipentaerythritol hexaacrylate and 1-hydroxycyclohexylphenylketone were dissolved in 2-butanone. Thereafter, with the addition of the finely-divided particles of antimony oxide with an average particle diameter of 20 nm to the above prepared solution, the resultant mixture was dispersed and ground for 96 hours using a paint shaker, so that a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 μm was provided on the intermediate layer.

Thus, a reversible thermosensitive recording medium No. 16 according to the present invention was fabricated.

EXAMPLE 17

Formation of Reversible Thermosensitive Recording Layer

The reversible thermosensitive recording layer was provided on the white polyester film serving as a support in the same manner as in Example 15.

Formation of Intermediate Layer

The intermediate layer was provided on the above prepared reversible thermosensitive recording layer in the same manner as in Example 15 except that the formulation for the intermediate layer coating liquid employed in Example 15 was changed to the following formulation:

(Formulation for intermediate layer coating liquid)

| | Parts by Weight |
|---|---|
| Ethylene-vinyl alcohol copolymer {Binder agent} | 10 |
| Finely-divided particles of cerium oxide (with an average particle diameter of 20 nm) {Inorganic pigment A} | 10 |
| Deionized water {Solvent} | 90 |
| n-propanol {Solvent} | 90 |

Formation of Protective Layer

The protective layer was provided on the above prepared intermediate layer in the same manner as in Example 16 except that the formulation for the protective layer coating liquid employed in Example 16 was changed to the following formulation:

(Formulation for protective layer coating liquid)

| | Parts by Weight |
|---|---|
| Dipentaerythritol hexaacrylate (Trademark "DPHA", made by Nippon Kayaku Co., Ltd.) | 10 |
| 1-hydroxycyclohexylphenyl-ketone (Trademark "Irgacure 184", made by Ciba-Geigy, Ltd.) | 0.1 |
| Finely-divided particles of silica (with an average particle diameter of 20 nm) {Inorganic pigment B} | 2.5 |
| 2-butanone | 45 |

Thus, a reversible thermosensitive recording medium No. 17 according to the present invention was fabricated.

EXAMPLE 18

Formation of Reversible Thermosensitive Recording Layer

The reversible thermosensitive recording layer was provided on the white polyester film serving as a support in the same manner as in Example 15.

Formation of Intermediate Layer

The intermediate layer was provided on the above prepared reversible thermosensitive recording layer in the same manner as in Example 15 except that the formulation for the intermediate layer coating liquid employed in Example 15 was changed to the following formulation:

(Formulation for intermediate layer coating liquid)

| | Parts by Weight |
|---|---|
| Ethylene-vinyl alcohol copolymer {Binder agent} | 10 |
| Finely-divided particles of molybdenum oxide (with an average particle diameter of 50 nm) {Inorganic pigment A} | 10 |
| Deionized water {Solvent} | 90 |

Formation of Protective Layer

The protective layer was provided on the above prepared intermediate layer in the same manner as in Example 16 except that the formulation for the protective layer coating liquid employed in Example 16 was changed to the following formulation:

(Formulation for protective layer coating liquid)

| | Parts by Weight |
|---|---|
| Dipentaerythritol hexaacrylate (Trademark "DPHA", made by Nippon Kayaku Co., Ltd.) | 10 |
| 1-hydroxycyclohexylphenyl-ketone (Trademark "Irgacure 184", made by Ciba-Geigy, Ltd.) | 0.1 |
| Finely-divided particles of alumina (with an average particle diameter of 20 nm) {Inorganic pigment B} | 2.5 |
| 2-butanone | 45 |

Thus, a reversible thermosensitive recording medium No. 18 according to the present invention was fabricated.

EXAMPLE 19

Formation of Reversible Thermosensitive Recording Layer

The reversible thermosensitive recording layer was provided on the white polyester film serving as a support in the same manner as in Example 15.

Formation of Intermediate Layer (Formulation for intermediate layer coating liquid)

| | Parts by Weight |
|---|---|
| Polyvinyl alcohol | 10 |
| Finely-divided particles of iron oxide (with an average particle diameter of 50 nm) | 10 |
| Sodium 2,2'-dihydroxy-4,4'-dimethoxybenzophenone-sulfonate (Trademark "UVINUL DS-49", organic ultraviolet absorbing agent, made by BASF Japan Ltd.) | 3 |
| Deionized water | 90 |

The above-mentioned polyvinyl alcohol and sodium 2,2'-dihydroxy-4,4'-dimethoxybenzophenone-sulfonate were completely dissolved in the deionized water. With the addition of the finely-divided particles of iron oxide with an average particle diameter of 50 nm to the above prepared solution, the resultant mixture was dispersed and ground for 96 hours using a paint shaker, so that a coating liquid for an intermediate layer was obtained.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer

The protective layer was provided on the intermediate layer in the same manner as in Example 15.

Thus, a reversible thermosensitive recording medium No. 19 according to the present invention was fabricated.

EXAMPLE 20

The reversible thermosensitive recording layer and the intermediate layer were successively overlaid on the white polyester film serving as a support in the same manner as in Example 2.

Formation of Protective Layer
(Formulation for protective layer coating liquid)

| | Parts by Weight |
|---|---|
| Dipentaerythritol hexaacrylate (Trademark "DPHA", made by Nippon Kayaku Co., Ltd.) | 10 |
| 1-hydroxycyclohexylphenyl-ketone (Trademark "Irgacure 184", made by Ciba-Geigy, Ltd.) | 0.1 |
| 2-(2'-hydroxy-5'-methylphenyl)-benzotriazole (Trademark "TINUVIN P", organic ultraviolet absorbing agent made by Ciba-Geigy, Ltd.) | 1 |
| 2 -butanone | 45 |

The above-mentioned dipentaerythritol hexaacrylate, 1-hydroxycyclohexylphenylketone and 2-(2'-hydroxy-5'-methylphenyl)benzotriazole were completely dissolved in 2-butanone, so that a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 $\mu$m was provided on the intermediate layer.

Thus, a reversible thermosensitive recording medium No. 20 according to the present invention was fabricated.

EXAMPLE 21

The procedure for fabrication of the reversible thermosensitive recording medium No. 3 in Example 3 was repeated except that the formulation for the protective layer coating liquid in Example 3 was replaced by the formulation for the protective layer coating liquid employed in Example 20.

Thus, a reversible thermosensitive recording medium No. 21 according to the present invention was fabricated.

EXAMPLE 22

The procedure for fabrication of the reversible thermosensitive recording medium No. 5 in Example 5 was repeated except that the formulation for the protective layer coating liquid in Example 5 was replaced by the formulation for the protective layer coating liquid employed in Example 20.

Thus, a reversible thermosensitive recording medium No. 22 according to the present invention was fabricated.

EXAMPLE 23

The procedure for fabrication of the reversible thermosensitive recording medium No. 6 in Example 6 was repeated except that the formulation for the protective layer coating liquid in Example 6 was replaced by the formulation for the protective layer coating liquid employed in Example 20.

Thus, a reversible thermosensitive recording medium No. 23 according to the present invention was fabricated.

EXAMPLE 24

The procedure for fabrication of the reversible thermosensitive recording medium No. 9 in Example 9 was repeated except that the formulation for the protective layer coating liquid in Example 9 was replaced by the formulation for the protective layer coating liquid employed in Example 20.

Thus, a reversible thermosensitive recording medium No. 24 according to the present invention was fabricated.

EXAMPLE 25

Formation of Reversible Thermosensitive Recording Layer

The reversible thermosensitive recording layer was provided on the white polyester film serving as a support in the same manner as in Example 11.

Formation of Intermediate Layer
(Formulation for intermediate layer coating liquid)

| | Parts by Weight |
|---|---|
| Polyvinyl alcohol | 10 |
| Sodium 2,2'-dihydroxy-4,4'-dimethoxybenzophenone-sulfonate (Trademark "UVINUL DS-49", organic ultraviolet absorbing agent, made by BASF Japan Ltd.) | 3 |
| Deionized water | 90 |

The above-mentioned polyvinyl alcohol and sodium 2,2'-dihydroxy-4,4'-dimethoxybenzophenone-sulfonate were completely dissolved in deionized water, so that a coating liquid for an intermediate layer was obtained.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer

The protective layer was provided on the intermediate layer in the same manner as in Example 11.

Thus, a reversible thermosensitive recording medium No. 25 according to the present invention was fabricated.

EXAMPLE 26

Formation of Reversible Thermosensitive Recording Layer

The reversible thermosensitive recording layer was provided on the white polyester film serving as a support in the same manner as in Example 13.

Formation of Intermediate Layer
(Formulation for intermediate layer coating liquid)

| | Parts by Weight |
|---|---|
| Polyvinyl butyral | 10 |
| 4-t-butyl-4'-methoxydibenzoyl-methane (Trademark "PARSOL 1789", organic ultraviolet absorbing agent, made by Givaudan Roure K. K.) | 1 |
| Isopropyl alcohol | 90 |

The above-mentioned polyvinyl butyral and 4-t-butyl-4'-methoxydibenzoylmethane were dissolved in isopropyl alcohol, so that a coating liquid for an intermediate layer was prepared.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer

The protective layer was provided on the above prepared intermediate layer in the same manner as in Example 13.

Thus, a reversible thermosensitive recording medium No. 26 according to the present invention was fabricated.

EXAMPLE 27

Formation of Reversible Thermosensitive Recording Layer

The reversible thermosensitive recording layer was provided on the white polyester film serving as a support in the same manner as in Example 15.

Formation of Intermediate Layer (Formulation for intermediate layer coating liquid)

| | Parts by Weight |
|---|---|
| Ethylene-vinyl alcohol copolymer | 10 |
| Finely-divided particles of zirconium oxide (with an average particle diameter of 30 nm) {Inorganic pigment B} | 10 |
| Sodium 2,2'-dihydroxy-4,4'-dimethoxybenzophenone-sulfonate (Trademark "UVINUL DS-49", organic ultraviolet absorbing agent, made by BASF Japan Ltd.) | 3 |
| Deionized water | 90 |

The above-mentioned ethylene—vinyl alcohol copolymer was completely dissolved in deionized water with stirring under the application of heat thereto. Thereafter, sodium 2,2'-dihydroxy-4,4'-dimethoxybenzophenone-sulfonate was completely dissolved in the above prepared solution. With the addition of the finely-divided particles of zirconium oxide with an average particle diameter of 30 nm to the above prepared solution, the resultant mixture was dispersed and ground for 96 hours using a paint shaker, so that a coating liquid for an intermediate layer was prepared.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer

The protective layer was provided on the above prepared intermediate layer in the same manner as in Example 15.

Thus, a reversible thermosensitive recording medium No. 27 according to the present invention was fabricated.

EXAMPLE 28

The reversible thermosensitive recording layer and the intermediate layer were successively provided on the white polyester film serving as a support in the same manner as in Example 16.

Formation of Protective Layer (Formulation for protective layer coating liquid)

| | Parts by Weight |
|---|---|
| Dipentaerythritol hexaacrylate (Trademark "DPHA", made by Nippon Kayaku Co., Ltd.) | 10 |
| 1-hydroxycyclohexylphenyl-ketone (Trademark "Irgacure 184", made by Ciba-Geigy, Ltd.) | 0.1 |
| Finely-divided particles of antimony oxide (with an average particle diameter of 20 nm) {Inorganic pigment B} | 2 |
| 2-(2'-hydroxy-5'-t-butylphenyl)-benzotriazole (Trademark "TINUVIN PS", organic ultraviolet absorbing agent made by Ciba-Geigy, Ltd.) | 1 |
| 2-butanone | 45 |

The above-mentioned dipentaerythritol hexaacrylate, 1-hydroxycyclohexylphenylketone, and 2-(2'-hydroxy-5'-t-butylphenyl)benzotriazole were dissolved in 2-butanone. Thereafter, with the addition of the finely-divided particles of antimony oxide with an average particle diameter of 20 nm to the above prepared solution, the resultant mixture was dispersed and ground for 96 hours using a paint shaker, so that a coating liquid for a protective layer was prepared.

The thus prepared coating liquid was coated on the above prepared intermediate layer using a wire bar, and cured by passing through an ultraviolet lamp of 80 W/cm at a transporting speed of 9 m/min. Thus, a protective layer with a thickness of 3 $\mu$m was provided on the intermediate layer.

Thus, a reversible thermosensitive recording medium No. 28 according to the present invention was fabricated.

COMPARATIVE EXAMPLE 1

Formation of Reversible Thermosensitive Recording Layer

The reversible thermosensitive recording layer was provided on the white polyester film serving as a support in the same manner as in Example 1.

Formation of Intermediate Layer (Formulation for intermediate layer coating liquid)

| | Parts by Weight |
|---|---|
| Polyvinyl alcohol | 10 |
| Deionized water | 90 |

The above-mentioned polyvinyl alcohol was completely dissolved in the deionized water, so that a coating liquid for an intermediate layer was obtained.

The thus obtained coating liquid was coated on the above prepared recording layer using a wire bar, and dried under the application of heat thereto, so that an intermediate layer with a thickness of about 2 $\mu$m was provided on the recording layer.

Formation of Protective Layer

The protective layer was provided on the above prepared intermediate layer in the same manner as in Example 1.

Thus, a comparative reversible thermosensitive recording medium No. 1 was fabricated.

Using each of the reversible thermosensitive recording media Nos. 1 to 28 according to the present invention and the comparative reversible thermosensitive recording medium No. 1, the light resistance stability test and the moisture resistance stability test were conducted in the following manners:

(1) Light resistance stability test

An image was recorded in one sample of each reversible thermosensitive recording medium using the commercially available thermal facsimile printing tester (Trademark "TH-PMD", made by Okura Electric Company) under the conditions that the dot density was 8 dots/mm, the applied voltage was 13.3 V, and the pulse width was 0.8 msec.

Thus, the reflection density of the recorded image and the density of the background portion were measured by use of mcBeth reflection densitometer RD-918.

Then, image erasure was performed in such a manner that a heat stamp of 140° C. was brought into contact with the sample of the recording medium for one second. After the completion of image erasure, the density of the decolorized image portion and that of the background portion were measured by the same densitometer as mentioned above. Those densities at the initial stage are shown in Table 1.

Furthermore, an image was recorded in another sample of the same recording medium as mentioned above in the same manner, and the thus recorded image was exposed to the fluorescent light of 5,000 lux for 100 hours.

Thereafter, image erasure was carried out using the heat stamp in the same manner as mentioned above. After the completion of image erasure, the density of the decolorized image portion and that of the background portion were measured by the same densitometer as mentioned above. Those values are also shown in Table 1.

The light resistance stability of the recording medium was evaluated in terms of the difference between the density of the background portion at the initial stage and the density of the decolorized image portion or that of the background portion after light exposure.

(2) Moisture resistance stability test

An image was recorded in each recording medium by the same method as previously mentioned, and the image contrast was obtained by subtracting the density of the background portion from the image density of the recorded image.

The thus obtained image-bearing sample of the recording medium was allowed to stand at 40° C. and 90% RH for 24 hours. After the storage for 24 hours, the image contrast was obtained in the same manner as mentioned above.

The moisture resistance stability of the recording medium was evaluated in terms of the ratio of the image contrast after the storage to that obtained before the storage.

The results are also shown in Table 1.

TABLE 1

| | Light Resistance Stability Test | | | | |
|---|---|---|---|---|---|
| | Initial stage | | After light exposure | | Moisture |
| | Density of decolorized image portion | Density of Background portion | Density of decolorized image portion | Density of Background portion | Resistance Stability Test (%) |
| Ex. 1 | 0.18 | 0.18 | 0.26 | 0.24 | 63 |
| Ex. 2 | 0.11 | 0.11 | 0.16 | 0.13 | 42 |
| Ex. 3 | 0.11 | 0.11 | 0.15 | 0.13 | 64 |

TABLE 1-continued

| | Light Resistance Stability Test | | | | |
|---|---|---|---|---|---|
| | Initial stage | | After light exposure | | Moisture |
| | Density of decolorized image portion | Density of Background portion | Density of decolorized image portion | Density of Background portion | Resistance Stability Test (%) |
| Ex. 4 | 0.11 | 0.11 | 0.15 | 0.13 | 61 |
| Ex. 5 | 0.14 | 0.14 | 0.22 | 0.19 | 46 |
| Ex. 6 | 0.14 | 0.14 | 0.21 | 0.18 | 62 |
| Ex. 7 | 0.11 | 0.11 | 0.14 | 0.13 | 83 |
| Ex. 8 | 0.11 | 0.11 | 0.15 | 0.13 | 79 |
| Ex. 9 | 0.11 | 0.11 | 0.14 | 0.13 | 81 |
| Ex. 10 | 0.12 | 0.12 | 0.16 | 0.15 | 82 |
| Ex. 11 | 0.11 | 0.11 | 0.15 | 0.14 | 57 |
| Ex. 12 | 0.11 | 0.11 | 0.19 | 0.16 | 41 |
| Ex. 13 | 0.14 | 0.14 | 0.19 | 0.16 | 47 |
| Ex. 14 | 0.11 | 0.11 | 0.14 | 0.13 | 82 |
| Ex. 15 | 0.11 | 0.11 | 0.15 | 0.13 | 75 |
| Ex. 16 | 0.11 | 0.11 | 0.13 | 0.12 | 85 |
| Ex. 17 | 0.11 | 0.11 | 0.13 | 0.12 | 80 |
| Ex. 18 | 0.12 | 0.12 | 0.14 | 0.13 | 85 |
| Ex. 19 | 0.17 | 0.17 | 0.24 | 0.22 | 62 |
| Ex. 20 | 0.11 | 0.11 | 0.14 | 0.12 | 43 |
| Ex. 21 | 0.09 | 0.09 | 0.11 | 0.10 | 65 |
| Ex. 22 | 0.12 | 0.12 | 0.16 | 0.14 | 47 |
| Ex. 23 | 0.12 | 0.12 | 0.17 | 0.16 | 80 |
| Ex. 24 | 0.09 | 0.09 | 0.11 | 0.10 | 84 |
| Ex. 25 | 0.09 | 0.09 | 0.11 | 0.11 | 59 |
| Ex. 26 | 0.12 | 0.12 | 0.15 | 0.14 | 45 |
| Ex. 27 | 0.10 | 0.10 | 0.13 | 0.13 | 84 |
| Ex. 28 | 0.09 | 0.09 | 0.10 | 0.10 | 85 |
| Comp. Ex. 1 | 0.13 | 0.13 | 0.23 | 0.18 | 30 |

As can be seen from the results shown in Table 1, when the reversible thermosensitive recording media of the present invention are subjected to image formation and erasure, the light resistance stabilities of the decolorized image portion and the background portion are excellent and the moisture resistance stability of the recorded image is also sufficient. This is because the inorganic pigment in the form of finely-divided particles with an average particle diameter of 100 nm or less is contained in the intermediate layer and/or the protective layer in the recording medium of the present invention.

Japanese Patent Application No. 08-208350 filed Aug. 7, 1996 and Japanese Patent Application filed Aug. 1, 1997 (as yet no application number having been assigned thereto) are hereby incorporated by reference.

What is claimed is:

1. A reversible thermosensitive recording medium comprising:

a support, a reversible thermosensitive recording layer formed on said support, comprising a reversible thermosensitive coloring composition which comprises an electron-donating coloring compound and an electron-accepting compound and is capable of assuming a colored state and/or a decolorized state by controlling the thermal energy applied to said coloring composition or the cooling rate of said coloring composition after the application of thermal energy thereto, an intermediate layer formed on said reversible thermosensitive recording layer, and a protective layer formed on said intermediate layer, at least one of said intermediate layer or said protective layer comprising an inorganic pigment material with an average particle diameter of 100 nm or less.

2. The reversible thermosensitive recording medium as claimed in claim 1, wherein said inorganic pigment material comprises an inorganic pigment which exhibits an absorption peak in a wavelength range of 400 nm or less.

3. The reversible thermosensitive recording medium as claimed in claim 1, wherein said inorganic pigment material comprises at least one inorganic pigment selected from the group consisting of an inorganic pigment which exhibits an absorption peak in a wavelength range of the ultraviolet radiation A, which is referred to as an inorganic pigment A, and an inorganic pigment which exhibits an absorption peak in a wavelength range shorter than the ultraviolet radiation A, which is referred to as an inorganic pigment B.

4. The reversible thermosensitive recording medium as claimed in claim 3, wherein both said inorganic pigment A and said inorganic pigment B are contained in one of said intermediate layer or said protective layer.

5. The reversible thermosensitive recording medium as claimed in claim 3, wherein one of said inorganic pigment A or said inorganic pigment B is contained in one of said intermediate layer or said protective layer, and the other inorganic pigment is contained in the other layer.

6. The reversible thermosensitive recording medium as claimed in claim 5, wherein said inorganic pigment A is contained in said intermediate layer, and said inorganic pigment B is contained in said protective layer.

7. The reversible thermosensitive recording medium as claimed in claim 1, wherein said inorganic pigment material is a metallic oxide.

8. The reversible thermosensitive recording medium as claimed in claim 1, wherein at least one of said intermediate layer or said protective layer further comprises an organic ultraviolet absorbing agent.

* * * * *